United States Patent [19]

Galle et al.

[11] Patent Number: 4,630,689

[45] Date of Patent: Dec. 23, 1986

[54] DOWNHOLE PRESSURE FLUCTUATING TOOL

[75] Inventors: Edward M. Galle, Friendswood; Billey E. Baker, Houston, both of Tex.

[73] Assignee: Hughes Tool Company-USA, Houston, Tex.

[21] Appl. No.: 708,207

[22] Filed: Mar. 4, 1985

[51] Int. Cl.[4] ..... E21B 7/24

[52] U.S. Cl. ..... 175/56; 137/804

[58] Field of Search ..... 175/56, 55; 166/249; 137/804, 835, 838, 826

[56] References Cited

U.S. PATENT DOCUMENTS

| | | | |
|---|---|---|---|
| 3,185,166 | 5/1965 | Horton et al. | 137/835 |
| 3,405,770 | 10/1968 | Galle et al. | 175/56 |
| 3,415,330 | 12/1968 | Bouyoucos | 175/56 |
| 3,441,094 | 4/1969 | Galle et al. | 175/56 |
| 3,450,217 | 6/1969 | Wise | 175/56 |
| 3,520,362 | 7/1970 | Galle | 166/249 |
| 3,524,461 | 9/1970 | Pavlin et al. | 137/835 |
| 3,532,174 | 10/1970 | Diamantides | 175/56 |
| 3,542,049 | 11/1970 | Kobayashi et al. | 137/804 |
| 3,648,786 | 3/1972 | Chenoweth | 175/56 |
| 3,815,691 | 6/1974 | Richter, Jr. et al. | 175/56 |
| 3,842,907 | 10/1974 | Baker et al. | 166/249 |
| 3,850,135 | 11/1974 | Galle | 116/137 |
| 3,860,902 | 1/1975 | Galle | 340/18 |
| 3,876,016 | 4/1975 | Stinson | 175/45 |
| 4,276,943 | 7/1981 | Holmes | 175/40 |

*Primary Examiner*—James A. Leppink
*Assistant Examiner*—Matthew Smith
*Attorney, Agent, or Firm*—Robert A. Felsman

[57] ABSTRACT

A downhole pressure fluctuating tool having an improved acoustical circuit using a fluid oscillator to generate out-of-phase pressure fluctuations in two output legs, one connected to an acoustical compliance inside the tool and the other connected to an acoustical compliance exterior of the tool in a cavity partially formed by the wall of the well. An acoustical inertance with a pressure node at its midregion connects the two acoustical compliances, and said midregion communicates with the annulus between the body of the tool and the wall of the well to discharge fluid from the body at the pressure node to minimize acoustical losses in the annulus.

3 Claims, 13 Drawing Figures

DOWNHOLE PRESSURE FLUCTUATING TOOL

BACKGROUND OF THE INVENTION

1. Field of the Invention

This invention relates in general to downhole tools used in boreholes and wells, and in particular to tools using fluid-driven acoustical oscillators and circuits to generate pressure fluctuations of large amplitude.

2. Background Information

In U.S. Pat. No. 3,405,770, Drilling Method and Apparatus Employing Pressure Variations in a Drilling Fluid, Oct. 15, 1968, are disclosed improved means for drilling boreholes in the earth by effecting elastic vibrations in the drilling fluid surrounding a rotating drill bit. In the preferred embodiment the fluid pressure at the borehole bottom is cyclically decreased, while simultaneously jet velocity and bit load are cyclically increased through the use of a bistable fluid oscillator, a coupler and resonators which cooperate to generate large fluid pressure fluctuations at the borehole bottom while minimizing acoustical energy transfer upward through the drilling fluid. The output of each of the two legs of the oscillator is fed into a cavity around the bit, after the phase of one output leg is inverted. Acoustical filters in the form of Helmholtz resonators C and D are connected respectively with the fluid passage or axial bore 121 with apertures 119 inside the tool leading to the bit and with the annulus with apertures 131 to minimize pressure losses and enhance efficiency.

Another apparatus and method used to isolate the out-of-phase pressure fluctuations of the output legs of a bistable fluidic oscillator are disclosed in U.S. Pat. No. 3,441,094, Drilling Methods and Apparatus Employing Out-Of-Phase Pressure Variations in a Drilling Fluid, Apr. 29, 1969.

Well stimulation apparatus and methods using the same general approach are disclosed in U.S. Pat. No. 3,520,362, Well Stimulation Method, July 14, 1970, in U.S. Pat. No. 3,842,907, Acoustic Methods for Fracturing Selected Zones in a Well Bore, Oct. 22, 1974, and in U.S. Pat. No. 3,850,135, Acoustical Vibration Generation Control Apparatus, Nov. 26, 1974.

A logging method which utilizes similar apparatus is disclosed in U.S. Pat. No. 3,860,902, Logging Method and system, Jan. 14, 1975, and a system for detecting the position of an acoustic generator in a borehole is disclosed in U.S. Pat. No. 3,876,016, Method and System for Determining the Position of an Acoustic Generator in a Borehole, Apr. 8, 1975.

Field experience and laboratory studies have been used to demonstrate the effectiveness of the above apparatus and methods for generating large pressure fluctuations useful in drilling, well treatment and logging. In the demonstrations a fluidic oscillator was used to alternately direct fluid between an exterior cavity and an interior cavity inside the too, with appropriate acoustical annulus filter means located one-quarter wavelength above, or above and below, the exterior cavity to minimize power dissipation in the annulus. The version of the tool shown in U.S. Pat. No. 3,520,362 is being used with successful results for well stimulation in a cased hole.

SUMMARY OF THE INVENTION

It is the general object of the invention to provide a downhole pressure fluctuating tool with a simplified improved acoustical circuit that eliminates the acoustical annulus filters while still minimizing acoustical energy losses in the annulus to enhance reliability and efficiency.

The above and other objects are accomplished by the use of an acoustical circuit that includes two acoustical compliances, each of which is connected to one of the two output legs of a fluid oscillator. One of the compliances has walls partially defined by the tool exterior and partially by the wall of the well and the other is formed inside the body of the tool. The two compliances are connected with an acoustical inertance which has a pressure node near its midsection and communicates with the annulus between the body of the tool and the wall of the hole at the pressure node, thus minimizing acoustical losses in the annulus and eliminating the need for acoustical annulus filters.

In the preferred form the acoustical inertance has two regions, the first region being formed between a lower portion of the body of the tool and the wall of the hole, with one end connected to the exterior acoustical compliance and the second region being formed by an internal passageway leading to the compliance inside the body of the tool. The acoustical elements in the circuit have values to create a pressure node at the return flow annulus, where each of the two regions of the acoustical inertance are discharged.

The above as well as additional objects, features and advantages will become apparent in the following description.

DESCRIPTION OF THE PREFERRED EMBODIMENT

Figure 1:
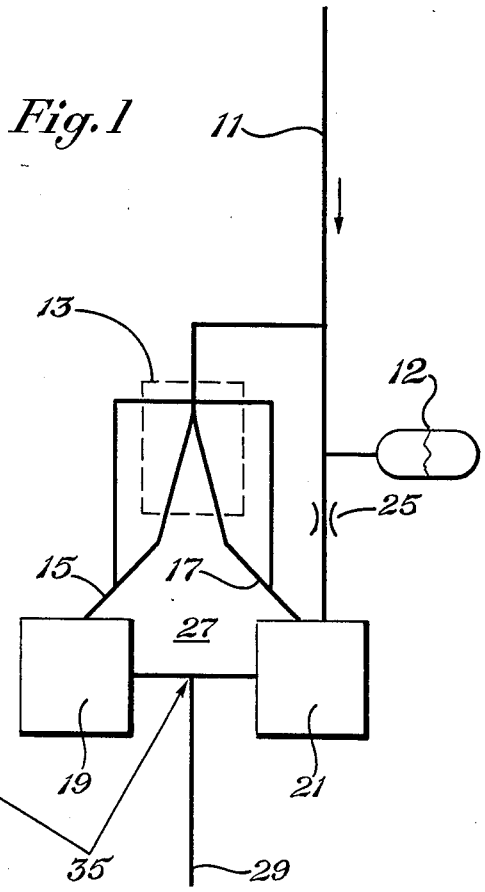
FIG. 1 is a schematic representation of the improved acoustical circuit and elements of the invention.

Referring initially to FIG. 1 of the drawings, the numeral 11 represents a fluid passage from a remote pump (not shown) that communicates with an acoustical filter 12 to minimize loss of acoustical energy upwardly through the passage. A bistable fluidic oscillator 13 receives fluid from passage 11 and discharges out-of-phase acoustical energy respectively into two output legs 15, 17.

In a configuration that enhances earth boring, acoustical energy from output leg 15 communicates with a tool cavity 19 formed inside a downhole tool to function as an interior acoustical compliance. The acoustical energy from output leg 17 communicates with bit cavity 21 which functions as an exterior acoustical compliance, with walls partially defined by the tool exterior and partially by the wall of the borehole.

The exterior compliance or bit cavity 21 also receives fluid from line 11 through bit nozzle 25. A flow passage 27 between the tool cavity 19 and the bit cavity 21 forms an acoustical inertance with a midregion 35 which communicates with the return flow annulus 29 at a pressure node to minimize acoustical losses in the annulus. The location of the pressure node depends upon the acoustical values of the flow passage 27 and the cavities 19,21 and need not be at the center of the passage 27. Thus the term "midregion" is used to cover a range and locations that can be established for the pressure node.

This acoustical circuit eliminates need for position sensitive annulus filters, and changes in hole size or formation properties do not increase the dissipation of acoustical energy in the fluid of the annulus. The reliability and efficiency of the tool is thereby enhanced.

Figure 2:
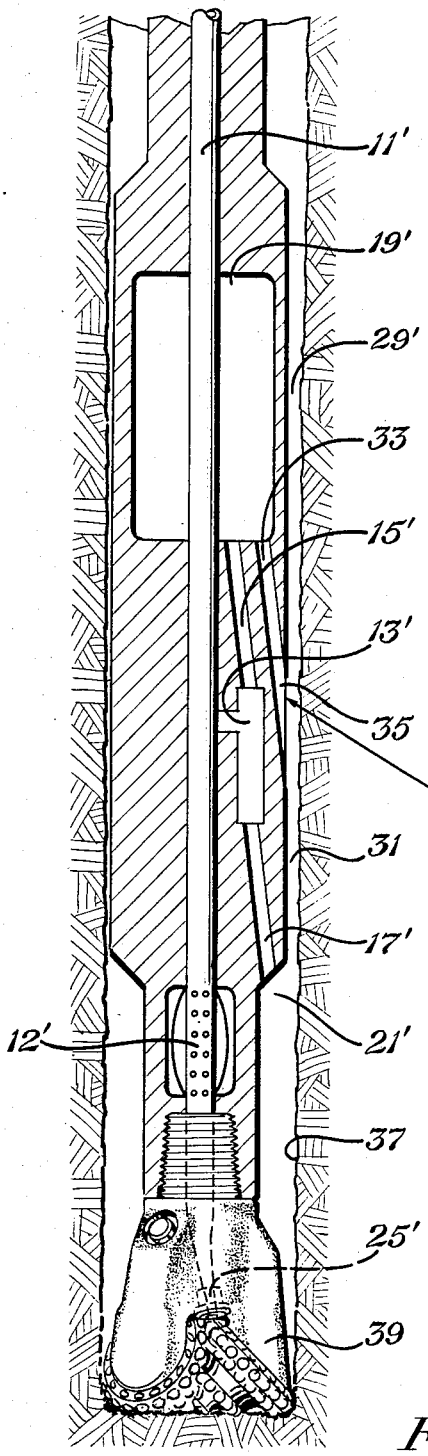
FIG. 2 is a representation of the lower portion of a downhole tool which embodies the acoustical circuit and elements of the invention in a configuration used to enhance drilling.

To assist visualization of a downhole tool configuration that contains the above described acoustical circuit and elements, FIG. 2 has been included in which the numeral 11' is an internal fluid passage that connects to a remote pump (not shown) which supplies drilling fluid to the tool. An acoustical filter to suppress pressure fluctuations in fluid passage 11' is represented by the numeral 12' and the bistable fluidic oscillator by the numeral 13', having an output leg 15' that communicates with the tool cavity 19' and another output leg 17' that communicates with the borehole cavity 21'.

As in the above circuit schematic, a flow passage and acoustical inertance communicates with a return flow annulus 29' at a midsection 35 of the inertance. This is accomplished by dividing the inertance into first and second regions 31, 33, the first being formed with a lower portion of the tool and the wall of the hole, and the second being a passage in an upper region of the tool. Each of the regions communicates with the return flow annulus.

The first region 31 of the acoustical inertance is formed between the exterior of the lower portion of the tool and the wall of the hole 37, and is dimensioned to provide a selected clearance with the wall of the hole to achieve a predetermined inertance value. The value of this inertance and that of the second region 33 are selected to produce a pressure node at their common junction 35.

While the FIG. 2 embodiment illustrates a configuration of the tool to enhance earth boring through use of a bit 39 and nozzles 25', the improved acoustical circuit and elements are advantageous in tools adapted for other downhole uses such as well stimulation, and alternate configurations will be apparent in view of the patents cited above.

Figure 3:
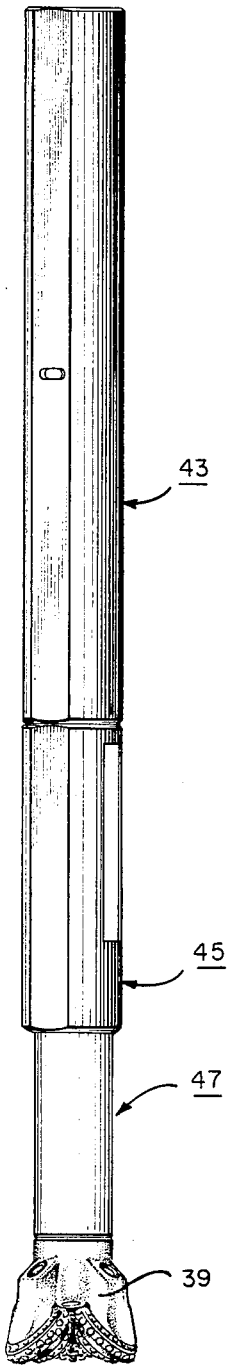
FIG. 3 is a side view of the downhole pressure fluctuating tool, coupled with a drill bit in the earth boring configuration.

The preferred exterior configuration of the tool is shown in FIG. 3, and includes three subassemblies: (1) A tool cavity sub 43, (2) an oscillator sub 45, and (3) an accumulator sub 47 connected by threads (not shown) to a drill bit 39. Each of the subassemblies or subs is threaded for coupling and uncoupling to complete the assembly for connection with pipe and a pump.

Figure 4:
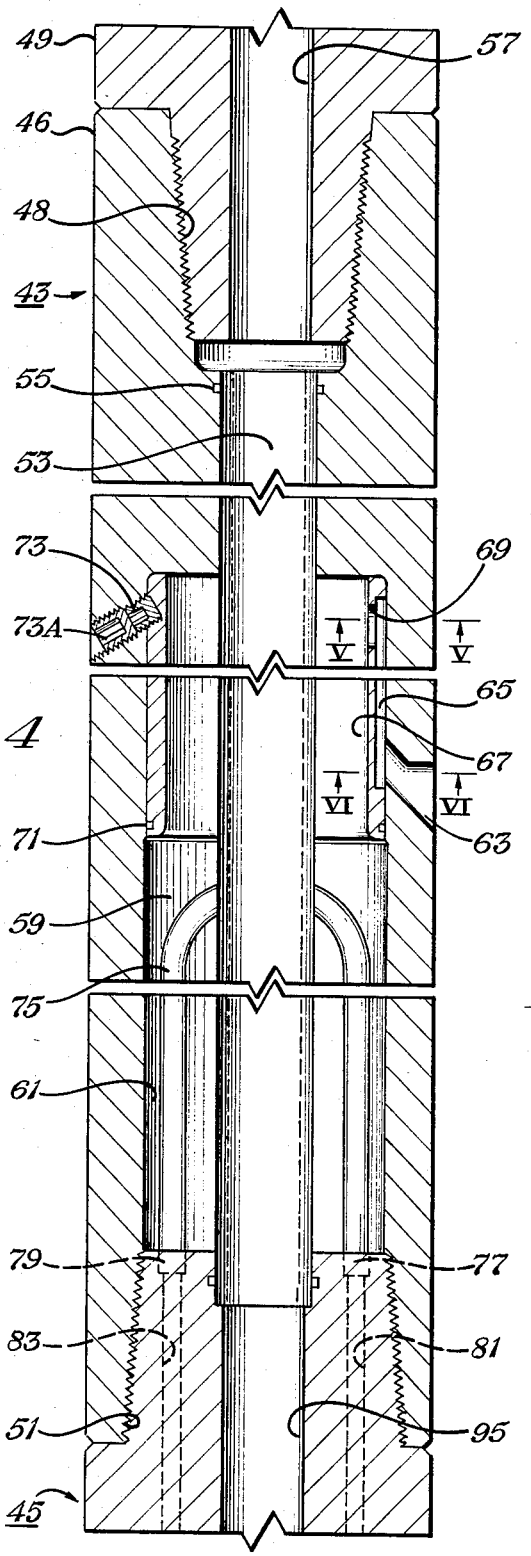
FIG. 4 is a side elevation view, in longitudinal section, of a tool cavity subassembly used to form the interior acoustical compliance inside the body of the tool.

The tool cavity sub 43 illustrated in FIG. 4 has a tubular body 46 threaded on its upper end at 48 to a drill string member 49 and with threads 51 at its lower end to an oscillator sub 45.

A central tube 53, sealed at 55, extends axially through the tool cavity sub 43 for communication with the fluid passage 57 of drill string member 49 that communicates with a pump (not shown) located at the surface for pumping fluid downhole.

Figure 5:
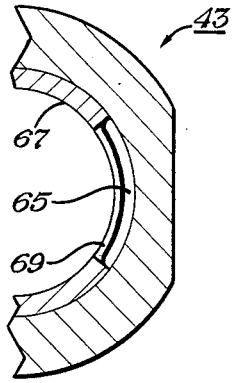
FIGS. 5 and 6 are fragmentary, cross-sectional views as seen looking respectively along the lines V—V and VI—VI of FIG. 4.
Figure 6:
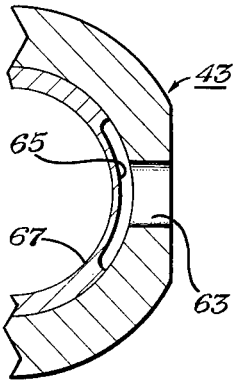

A tool cavity 59 which functions as a compliance is formed between the central tube 53 and an interior cylindrical wall 61, and communicates with the annulus through a port 63, a slot 65, formed partially in a sleeve 67 as seen in FIGS. 5 and 6, and an opening 69, the sleeve being sealed as indicated at 71 and held in position by a suitable fasteners such as a set screw 73 and pipe plug 73A.

Inside the tool cavity are a pair of similar, U-shaped tubes 75, 75' only one of which 75 is visible in the sectional view of FIG. 4. Each of the respective ends 77, 79 of the visible tube 75 communicates with a respective drilled hole 81, 83 in an upper portion of oscillator subassembly 45. The lower portions of the drilled holes 81, 83 designated respectively 89, 91 (see FIG. 7) are passages that intersect feedback channels (to be described later) of a bistable fluidic oscillator 93, fabricated sectionally of a wear resistant material such as cemented tungsten carbide and being of the same general configuration as that which is disclosed in U.S. Pat. No. 3,405,770.

The oscillator sub 45 (see FIG. 7) has a central passage 95 to communicate with the central tube 53, is threaded at 97 in its lower end for connection to the accumulator sub 47, and has a passage 99 to connect the fluidic oscillator with the bit cavity 21' (as shown schematically in FIG. 2). The oscillator is held in the subassembly with a plurality of cap screws such as those designated 101, 103, 105 in FIG. 7, some of which also hold a cover plate 107 over the oscillator.

The sectional views of FIGS. 8–11 show additional constructional features of the oscillator subassembly 45. Note that each of these cross sectional views shows the entire cross section of the oscillator subassembly 45, even though taken from the longitudinal section of FIG. 7, to simplify and reduce the number of figures of the drawings.

Figure 7:
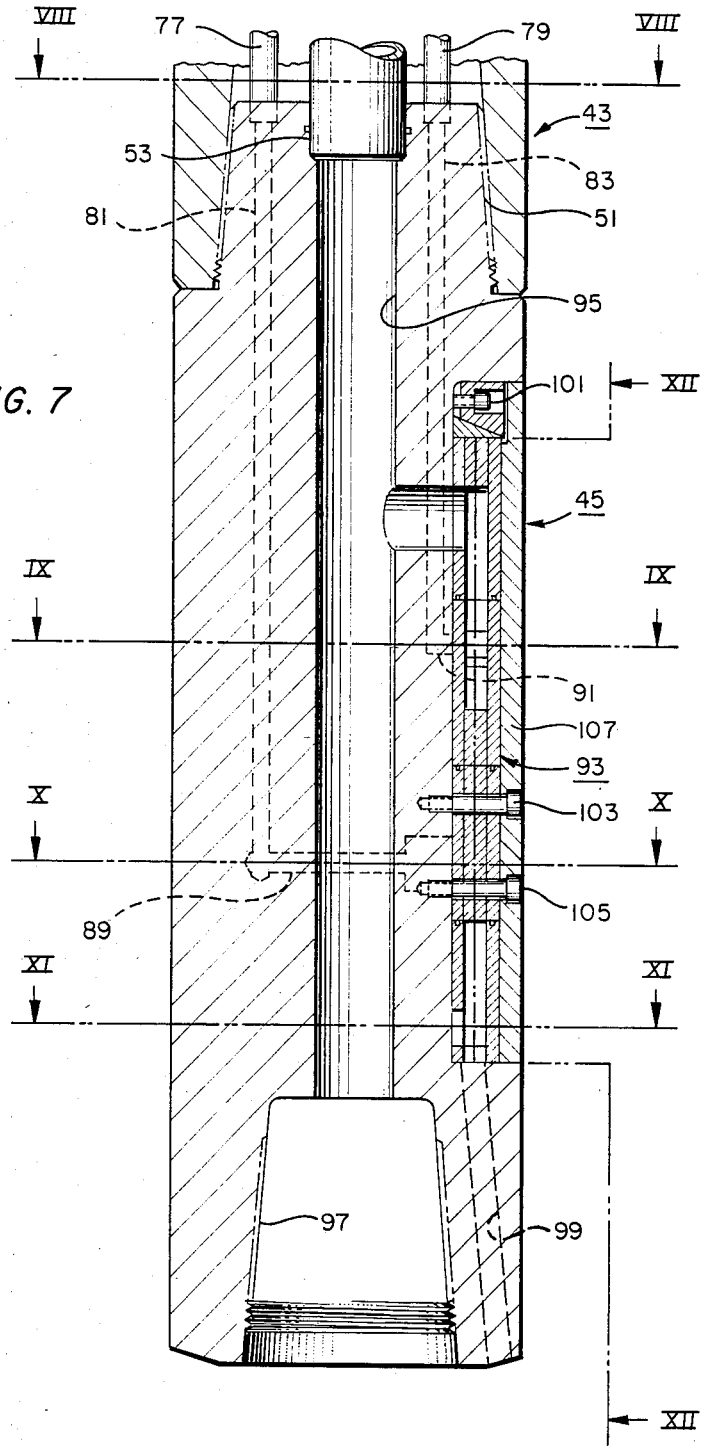
FIG. 7 is an oscillator subassembly, which is used to house a bistable fluidic oscillator, the preferred type of oscillator used in practicing the invention.
Figure 8:
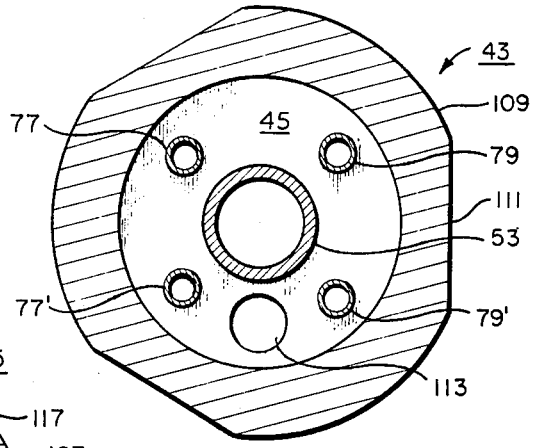
FIGS. 8, 9, 10 and 11 are cross-sectional views as seen looking respectively along the lines VIII—VIII through XI—XI of FIG. 7.

Referring initially to FIG. 8, the exterior of the sub 43 has circular portions 109 and planar portions 111, which cooperate to form one region of an inertance that separates the tool cavity or compliance 59 from a cavity around the bit (similar to the cavity 21' shown schematically in FIG. 2). Inside the sub 43, concentric with its centerline, is the central tube 53 for the passage of fluid from a remote pump (not shown) as previously described. In FIG. 8 the ends 77, 79 of the U-tube 75, are shown, as are the ends 77', 79' (not shown in FIG. 7) of the other U-tube 75'. Also shown is the end of passage 113 in the oscillator sub 45, which connects the oscillator with the tool cavity 59 (shown in FIG. 4).

Figure 9:
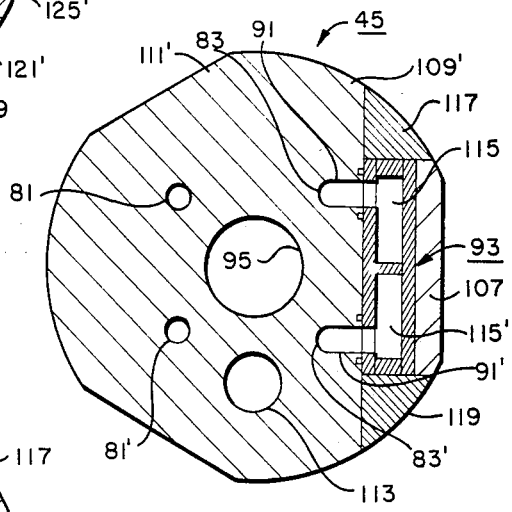

Section IX—IX shown in FIG. 9 shows the exterior, circular portions 109' and the planar portions 111' of the oscillator subassembly 45, which surfaces match those designated 109 and 111 of the tool cavity subassembly 43 and form together an inertance passage between the wall of the well and the subs 43, 45. The lateral portions 91, 91' of the feedback passages 83, 83' connect respectively with chambers 115, 115' of the bistable fluidic oscillator 93, which is held in position in the assembly with the previously mentioned cover plate 107 and in addition, by the side plates 117, 119. The other feedback passages 81, 81' continue downwardly.

Figure 10:
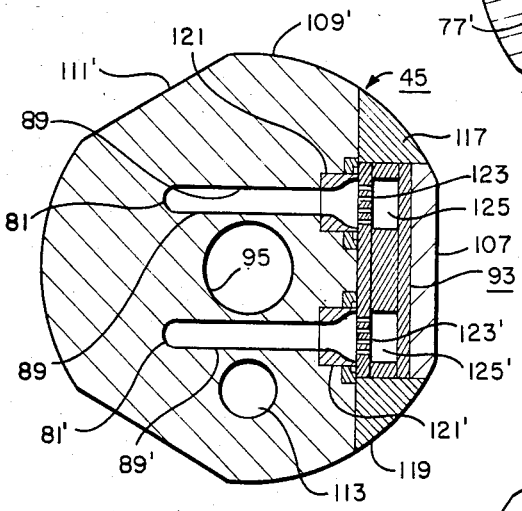
Figure 12:
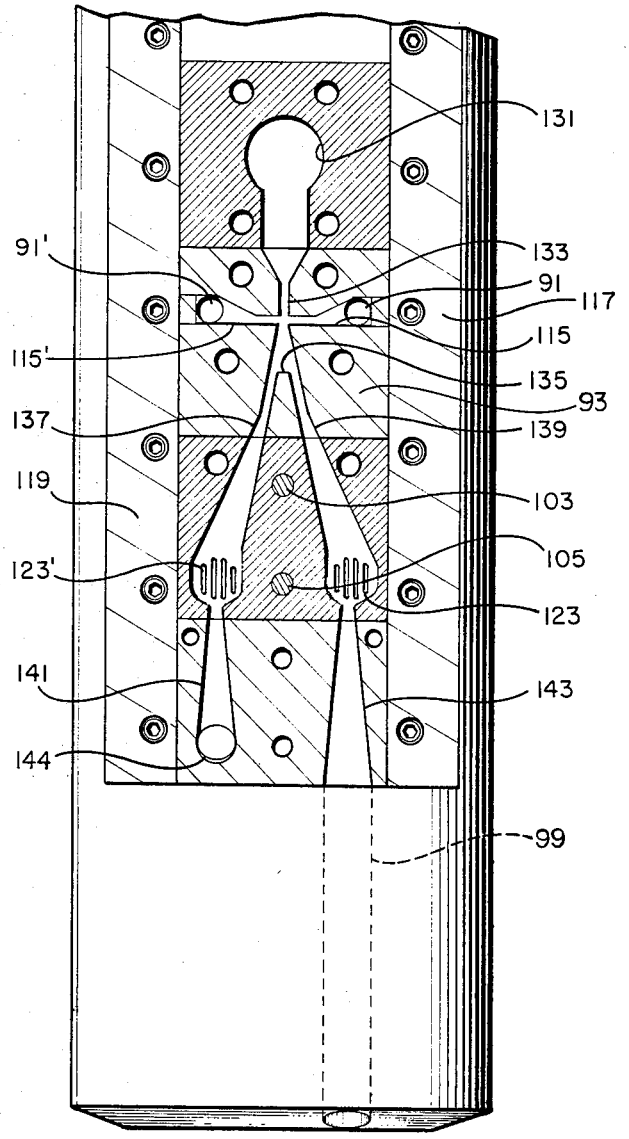
FIG. 12 is a side elevation view, partially in longitudinal section, of the preferred bistable fluidic oscillator as seen looking along the lines XII—XII of FIG. 7.

FIG. 10 shows section X—X of FIG. 7, principally to indicate that the passages 81, 81' intersect passages 89, 89' leading to nozzles 121, 121', screens 123, 123' and chambers 125, 125' of the sectional fluidic oscillator (see also FIG. 12 of the oscillator).

Figure 11:
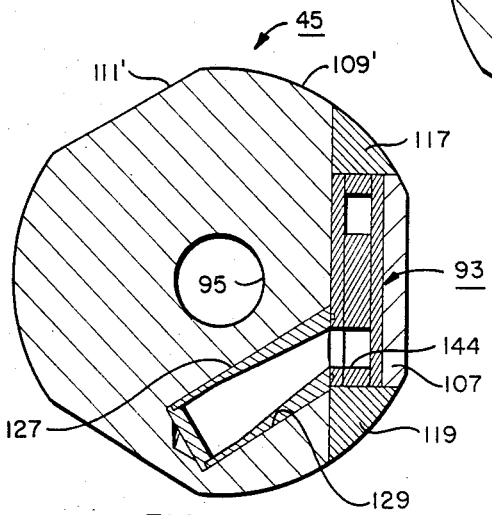

Section XI—XI shown in FIG. 11 discloses the exterior surfaces 109', 111' of the oscillator sub 45, the central passage 95, the fluidic oscillator 93, its cover plate 107 and its end plates 117, 119. More importantly, a wear resistant insert 127 lines a passage 129 that intersects passage 113 (see FIG. 10) leading to the cavity 59 in the tool cavity subassembly 43 from a port 144 associated with one output leg in the oscillator 93 (see FIG. 12).

FIG. 12 is a sectional view as seen looking along the lines XII—XII of FIG. 7, in which the wear resistant bistable fluidic oscillator 93 appears in a view that shows the input port 131 that receives fluid from the central passage 95 to drive the oscillator. The input fluid flows through a power nozzle 133, to a splitter 135, and into splitter channels 137, 139. A part of the fluid is diverted through ports 123, 123' into passages 89, 89', through passages 81, 81', tubes 75, 75' passages 83, 83' and passages 91, 91' into chambers 115, 115' of the bistable fluidic oscillator. Finally, the output from the splitter channels 137, 139 passes through the output legs 141, 143 respectively into output port 144 going to the tool cavity 59 and output passage 99 leading to the bit cavity.

Figure 13:
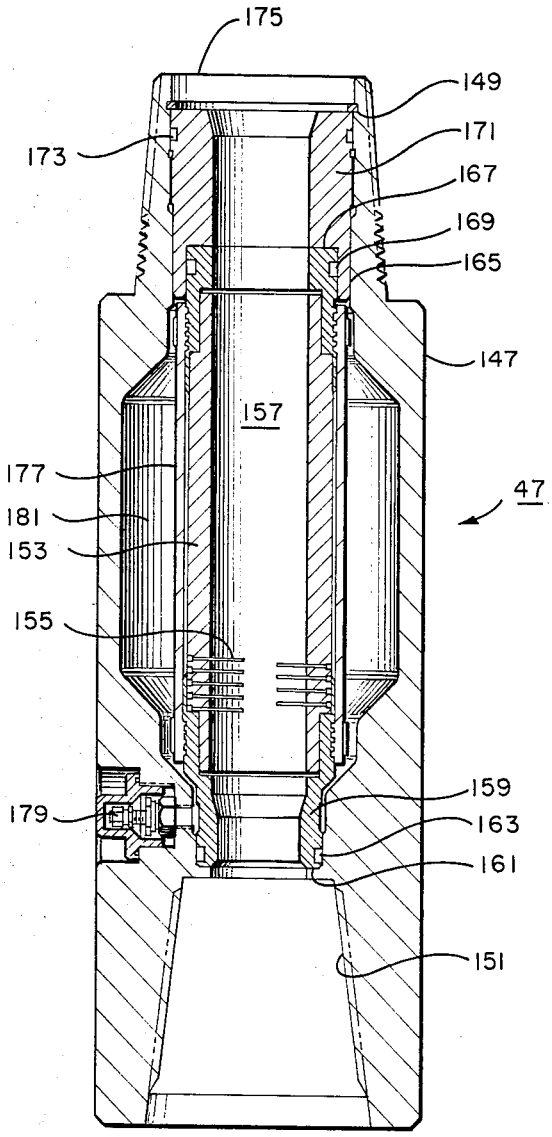
FIG. 13 is a side elevation view, in longitudinal section, of an acoustical filter subassembly which minimizes loss of acoustical energy up the bore of the tool.

The accumulator subassembly 47 is shown in FIG. 13 and is similar to off-the-shelf pressure desurgers such as that which is known as the "Bethlehem Hydraulic Desurger" manufactured by Bethlehem Corporation. In the modified form shown in FIG. 13, the accumulator has a body 147 threaded at its upper end, as indicated by the numeral 149, for connection to the oscillator sub 45, and at its lower end 151 to receive a drill bit.

A mandrel 153, slotted at 155 to communicate with fluid flowing through the sub central passage 157, is held inside the body 147 with a lower nipple 159, seated on a shoulder 161 in a lower portion of the body and sealed at 163. The upper end of the mandrel 153 is held by an upper nipple 165, which engages a shoulder 167 and is sealed at 169 against a retainer cap 171, sealed at 173 to the body 147. A resilient snap ring 175 maintains the mandrel 153, nipples 159 and 165, and the retainer cap 171 in the designated positions.

A tubular and resilient sleeve 177 is bonded at its upper end to the upper nipple 165 and at its lower end to the lower nipple 159. Pressurized gas is fed through a one way valve 179 to adjust the pressure in a reservoir 181 inside the body and exterior of the resilient sleeve 177. Hence pressure fluctuations inside the passage 157 are absorbed by the resulting changes in the volume and pressure of the gas in reservoir 181.

In operation a drill string is made up such that it's lower end consists of a drill bit 39, accumulator sub 47, oscillator sub 45, and the tool cavity sub 43, as indicated in FIG. 3. From a drill rig (not shown) at the surface of the earth the subs and bit are rotated while drilling fluid is diverted through the fluidic oscillator 93 to generate out-of-phase pressure fluctuations in the output legs 141, 143 (see FIG. 12), which are fed respectively to the tool cavity 59 and to the cavity around the bit. These two cavities are connected by an inertance having two regions, one of which is connected with the annulus by the port 63 in the tool cavity sub 43 and the other of which is connected with the cavity around the bit through the passage 99. The two cavities are acoustical compliances which with the other acoustical circuit elements have values to create a pressure node in the annulus where the two regions of the inertance discharge. This minimizes the loss of acoustical energy in the drilling fluid above the assembly.

While the invention has been shown in only its preferred form, it should be apparent that it is not thus limited, but is susceptible to various changes and modifications without departing from the spirit thereof.

We claim:

1. A pump drive, downhole pressure fluctuating tool having an improved acoustical circuit that comprises:

a body adapted for connection with a string of pipe in a well, with a passage to receive liquid from the pump;

a fluid oscillator connected with the passage of the body, including two output leg means to generate out-of-phase pressure fluctuations;

two acoustical compliance means, each connected to an output leg, one of said compliance means having walls partially defined by the tool exterior and partially by the wall of well and the other being defined by walls inside the tool;

an acoustical inertance means connecting the two acoustical compliance means, with a pressure node at the midregion, said midregion communicating with the annulus between the body and the wall of the hole to discharge fluid from the body.

2. A pump driven, downhole pressure fluctuating tool having an improved acoustical circuit that comprises:

a body adapted for connection with a string of pipe in a well, with an interior passage to receive liquid from the pump;

a fluidic oscillator connected with the interior passage of the body, including two output leg means to generate out-of-phase pressure fluctuations;

an exterior acoustical compliance means connected to one output leg, with walls partially defined by the tool exterior and partially by the wall of the well;

an interior acoustical compliance means inside the body and connected to the other of the output leg means;

an acoustical inertance means connecting the exterior and interior acoustical compliance means, with a pressure node at the midregion, said midregion communicating with the annulus between the body and the wall of the hole to discharge fluid from the body at a pressure node to minimize acoustical losses in the annulus.

3. A pump drive downhole pressure fluctuating tool having an improved acoustical circuit and elements that comprise:

a tubular body adapted for connection with a string of pipe in a well, with an interior passage to receive liquid from the pump;

a bistable fluidic oscillator connected with the interior passage of the body, including two output leg means to generate out-of-phase pressure fluctuations;

an exterior acoustical compliance means connected to one output leg means with walls partially defined by the tool exterior and partially by the wall of the well;

an interior acoustical compliance means inside the body, connected to the other of the output leg means;

an acoustical inertance means between the acoustical compliance means having two flow regions, the first region being formed between a lower portion of the body and the wall of the well; the second region formed within the body, the intersection of the two regions communicating with the return flow annulus;

the acoustical elements having values to generate a pressure node at the intersection of the two regions of the inertance.

* * * * *